US007275691B1

(12) United States Patent
Wright et al.

(10) Patent No.: US 7,275,691 B1
(45) Date of Patent: Oct. 2, 2007

(54) ARTILLERY FIRE CONTROL SYSTEM

(76) Inventors: Curtis Wright, 140 Schwarz Blvd., Lake Hopatcong, NJ (US) 07849; Thomas Bradley, 55 Third St., Fanwood, NJ (US) 07823

( * ) Notice: Subject to any disclaimer, the term of this patent is extended or adjusted under 35 U.S.C. 154(b) by 169 days.

(21) Appl. No.: 10/904,686

(22) Filed: Nov. 23, 2004

Related U.S. Application Data

(60) Provisional application No. 60/525,109, filed on Nov. 25, 2003.

(51) Int. Cl.
*G06F 19/00* (2006.01)

(52) U.S. Cl. ..... 235/404; 235/417; 244/3.11; 342/357.02

(58) Field of Classification Search ..... 235/400, 235/401, 404; 244/3.1; 434/11, 16; 342/357.01, 342/357.02
See application file for complete search history.

(56) References Cited

U.S. PATENT DOCUMENTS 5,690,491 A * 11/1997 FitzGerald et al. ..... 434/16
6,069,584 A * 5/2000 Johnson ..... 342/357.09
6,211,816 B1 * 4/2001 Westphal ..... 342/357.03
6,254,394 B1 * 7/2001 Draper et al. ..... 434/11
6,281,841 B1 * 8/2001 Nevill ..... 342/424
6,283,756 B1 * 9/2001 Danckwerth et al. ..... 434/11
RE37,547 E * 2/2002 Anagnost ..... 702/153
6,386,879 B1 * 5/2002 Varshneya et al. ..... 434/16
6,779,752 B1 * 8/2004 Ratkovic ..... 244/3.15
6,952,001 B2 * 10/2005 McKendree et al. ..... 244/3.1
7,047,861 B2 * 5/2006 Solomon ..... 89/1.11
7,092,867 B2 * 8/2006 Huang et al. ..... 703/21
7,098,846 B2 * 8/2006 Nielsen et al. ..... 342/357.02

* cited by examiner

*Primary Examiner*—Ahshik Kim
(74) *Attorney, Agent, or Firm*—Robert Charles Beam; John F. Moran

(57) ABSTRACT

An indirect artillery fire control system is shown, in which a plurality of indirect artillery systems are linked with a fire direction system such that a call for fire order is communicated as a fire command to a selected indirect artillery system, with that system being selected by reason of a characteristic of that indirect artillery system.

20 Claims, 12 Drawing Sheets

ARTILLERY FIRE CONTROL SYSTEM

CROSS REFERENCE TO RELATED APPLICATIONS

This Application claims priority of U.S. Patent Application Ser. No. 60/525,109, filed Nov. 25, 2003, entitled Software Architecture Mortar Fire Control System, the entire disclosure of which is hereby incorporated by reference as if being set forth in its entirety herein.

FEDERAL STATEMENT INTEREST

The inventions described herein may be manufactured, used and licensed by or for the U.S. Government for U.S. Government purposes.

BACKGROUND OF INVENTION

1. Field of Invention

The present invention relates generally to indirect fire systems and methods.

2. Background of the Invention

Indirect artillery fire systems, such as mortar systems, are known to be effective. For example, mortars may provide indirect fires that are organizationally responsive to ground maneuvers. In general, indirect fire systems are exceptionally well suited for attacking entrenched enemy troops and targets, which are not vulnerable to attack by direct fires. Indirect fire forces, such as mortar sections and platoons, play an important part of the total fire support system. Accordingly, it is desirable to improve these forces' efficiency and effectiveness.

SUMMARY OF THE INVENTION

An artillery fire control system including: a plurality of artillery systems, each artillery system including code for receiving a fire command, code for computing a ballistic solution corresponding to the received fire command, code for comparing the computed ballistic solution with the fire command, and code for readying the artillery system to fire only if the comparing indicates a substantial match; and, a fire direction system including: code for receiving a call for fire order from a command, code for selecting at least one of the plurality of artillery systems dependently upon at least one characteristic of the plurality of artillery systems, and code for issuing a fire command corresponding to the call for fire order to the selected at least one of the plurality of artillery systems.

BRIEF DESCRIPTION OF THE FIGURES

Understanding of the present invention will be facilitated by consideration of the following detailed description of the preferred embodiments of the present invention taken in conjunction with the accompanying drawings, wherein like numerals refer to like parts and.

DETAILED DESCRIPTION OF THE PREFERRED EMBODIMENTS

It is to be understood that the figures and descriptions of the present invention have been simplified to illustrate elements that are relevant for a clear understanding of the present invention, while eliminating, for purposes of clarity, many other elements found in typical indirect fire systems and methods. Those of ordinary skill in the art will recognize that other elements are desirable and/or required in order to implement the present invention. However, because such elements are well known in the art, and because they do not facilitate a better understanding of the present invention, a discussion of such elements is not provided herein.

According to an aspect of the present invention, an indirect fire control system and method is provided. The present invention will be described as it relates to a Mortar Fire Control System (MFCS) for purposes of clarity. It should be understood that the present invention also has applicability to other indirect fire systems as well.

According to an aspect of the present invention, a Mortar Fire Control System (MFCS) integrates with mortars and their transportation systems to provide a combined digital warfare system. A system according to an aspect of the present invention may provide primary indirect fire support for armored and mechanized infantry battalions with digital and automated fire direction and control capabilities, for example.

According to an aspect of the present invention, an MFCS may include at least one Fire Direction Center (FDC) node, at least one gun system node, and/or at least one FDC/gun node. These nodes may be operated by corresponding mortar and FDC crews, such as crews including one or more operators, gunners and drivers. According to an aspect of the present invention, an MFCS may provide for self-surveying mortars, digital call for fire exchange and automated ballistic solutions. Training and logistics improvements may also be supported. As will be recognized by those possessing an ordinary skill in the pertinent arts, this provides greatly increased capability over current non-digitized mortar fire control.

Figure 1:
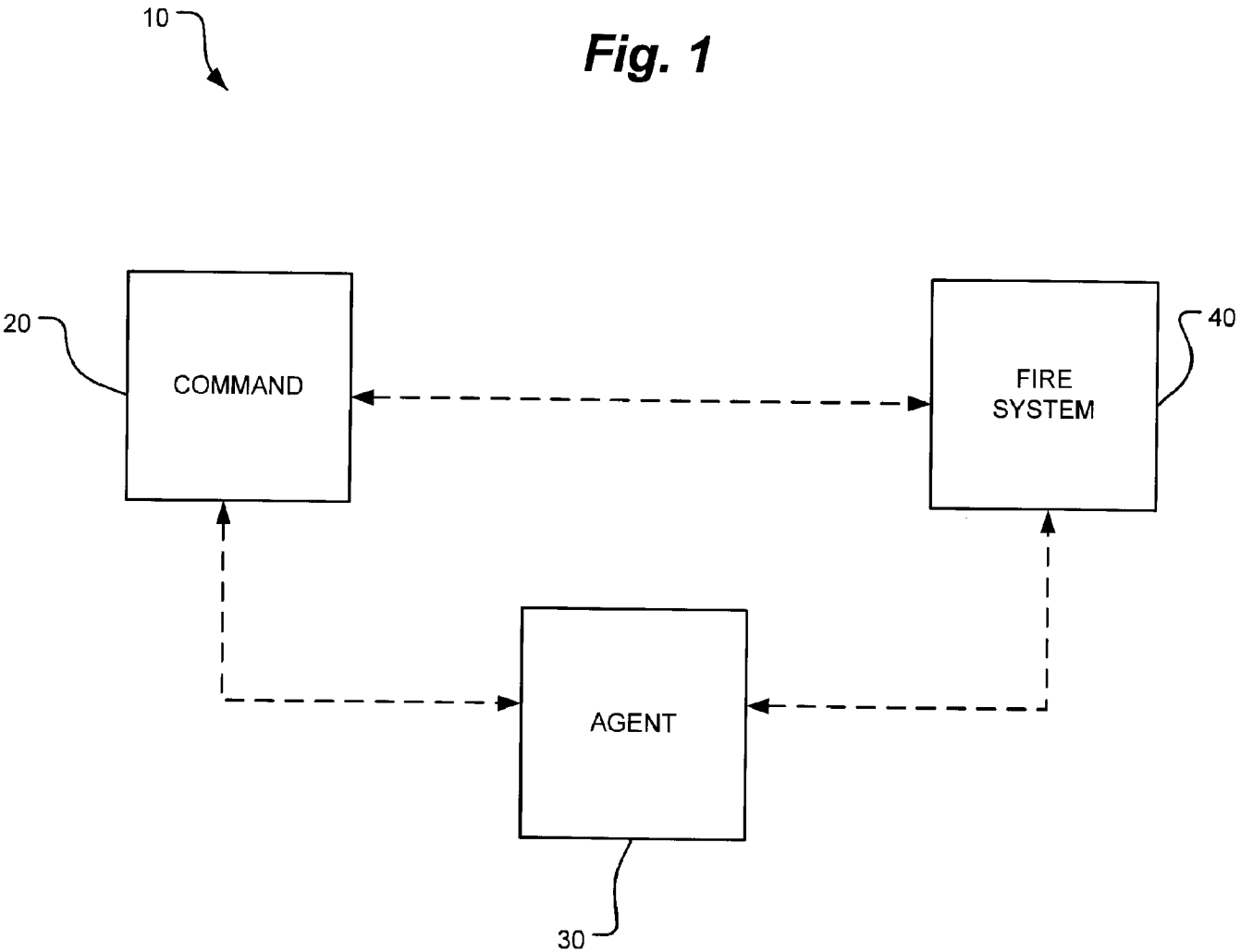
FIG. 1 illustrates a block diagrammatic representation of a fire control system according to an aspect of the present invention.

Referring now to FIG. 1, there is shown a diagrammatic representation of an indirect fire control system 10 according to an aspect of the present invention. System 10 generally includes one or more commands 20, one or more agents 30 and one or more indirect fire systems 40. Each of the command, agent and fire systems may be in communication with one another, such as by using wireless communications, like Radio Frequency (RF) signals.

Command 20 may take the form of a conventional military command in a hierarchical command structure. The present invention will be discussed as it relates to a command in the form of an U.S. Army Battalion Tactical Operations Center (TOC). In this case, TOC 20 may typically include a Force XXI Battle Command Battalion/Brigade and Below (FBCB2) system, a Main Control System (MCS) and an Advanced Field Artillery Tactical Data System (AFATDS).

These elements are well understood by those possessing an ordinary skill in the pertinent arts. For example, the FBCB2 system provides for general situational awareness.

The MCS provides for maneuver control system. AFATDS provides for general battalion level fire support. As will be recognized by those possessing such a skill, other systems that comply with different protocols and standards than the systems identified here may of course be used, in addition to, or in lieu of, the systems described herein without adversely affecting performance of an MFCS according to the present invention.

Agent 30 may take the form of a forward observer. Agent 30 generally makes calls for fire. Agent 30 may take the form of individuals, or groups of individuals, being supported by fire system 40 and directly or indirectly under the command of command 20.

Figure 2:
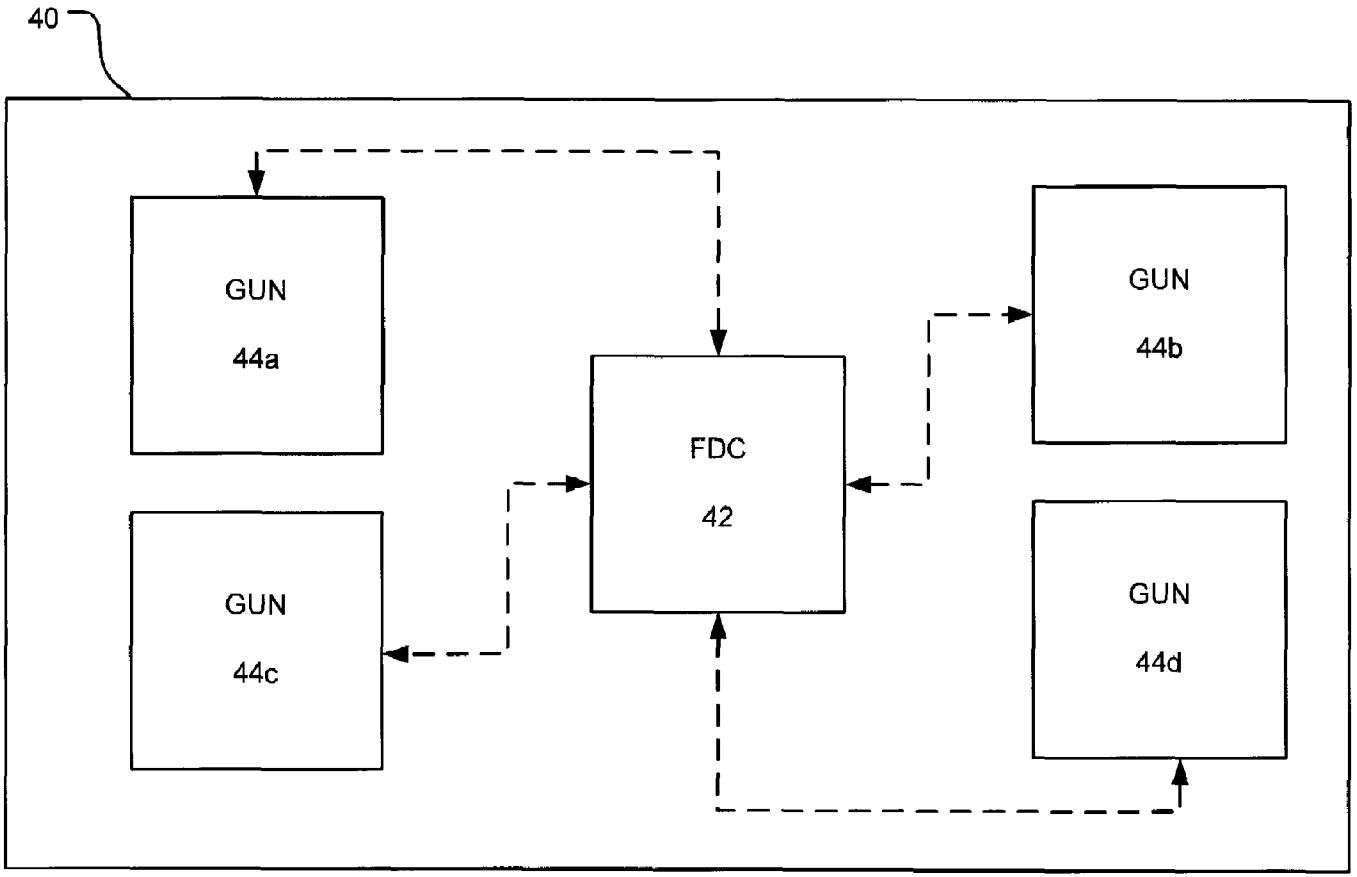
FIG. 2 illustrates a block diagrammatic representation of the components of a mortar fire control system (MFCS) according to an aspect of the present invention.

Referring now also to FIG. 2, there is shown a non-limiting example of a fire system 40 suitable for use with system 10. System 40 generally includes one or more fire direction control (FDC) systems 42 and one or more gun systems 44. System 40 may also include other systems, such as an FBCB2 system, for example. Each of the FDC and gun systems may be in communication with one another, such as by using wireless communications, like Radio Frequency (RF) signals. In the exemplary case of FIG. 2, a single FDC 42 and four gun systems 44*a*-44*d* are shown. FDC 42 and guns 44 may be physically independent of one another.

Figure 3:
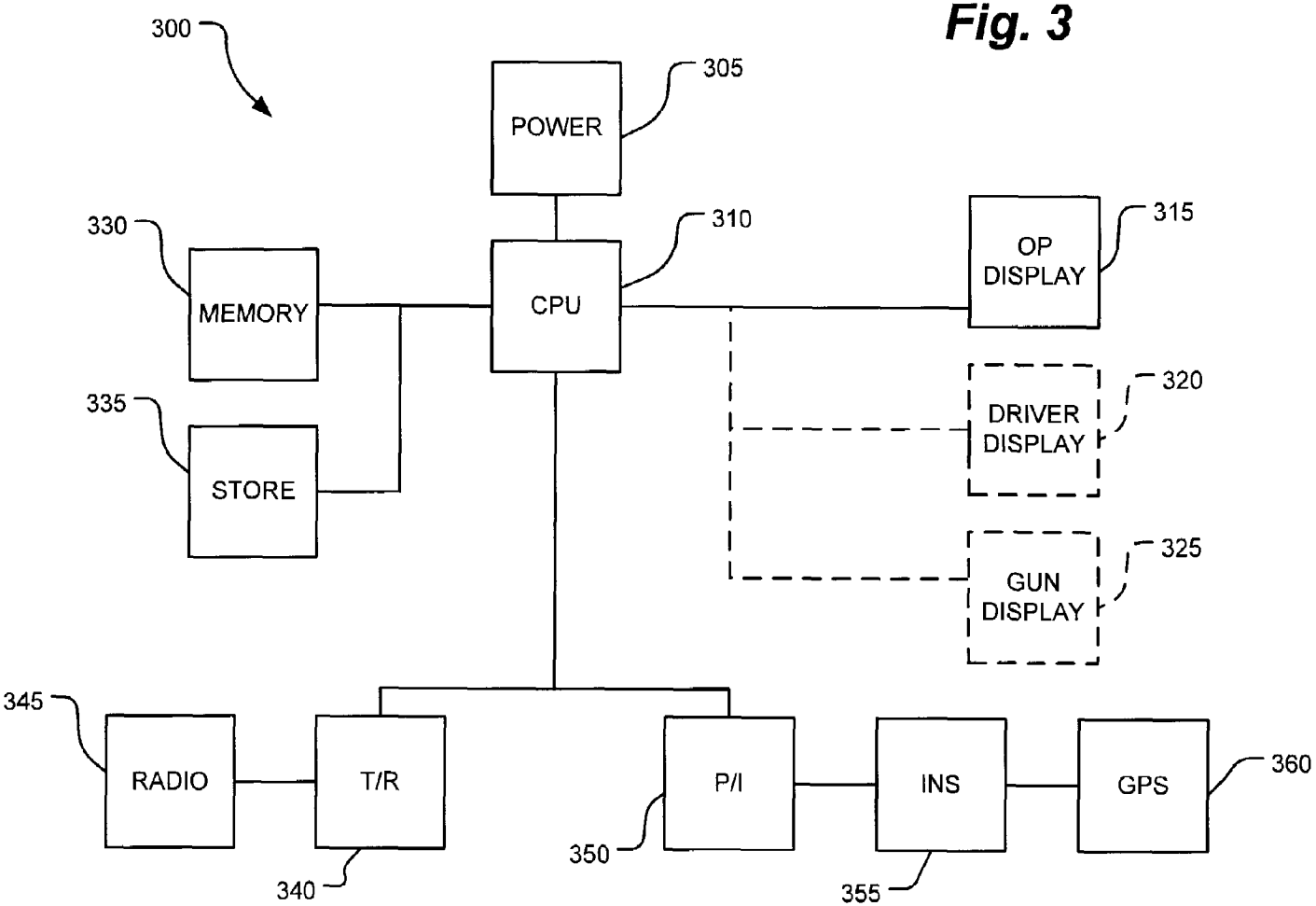
FIG. 3 illustrates a block diagrammatic representation of a fire direction center/gun interface system according to an aspect of the present invention.

Referring now also to FIG. 3, there is shown a block diagrammatic representation of a system 300 suitable for use as a FDC 42 (FIG. 2), a gun system 44 (FIG. 2), or both. System 300 may operate using a power supply 305. Supply 305 may take the form of a battery, generator or existing power system conditioner for example. System 300 generally includes a processor 310. Processor 310 may take the form of a Pentium processor available from Intel, for example. System 300 generally includes an operator display 315, driver display 320 and gunner display 325. Each display may take the form of a conventional text and/or graphical user interface (GUI) display. System 300 may include memory 330, such as conventional volatile or non-volatile RAM and ROM memory devices. System 300 may include a data store 335 that may take the form of a conventional disk drive or flash memory card, by way of non-limiting example. System 300 may include a transmit/receive interface 340 for a radio 345, where system 10 (FIG. 1) uses RF transmissions. T/R interface 340 may take the form of a modulator/demodulator (MODEM), for example. System 300 may include a peripheral interface 350, such as a serial interface, like a universal serial bus (USB), RS-232 or RS-422 interface. Interface 350 may provide interconnection with a conventional Inertial Navigation System (INS) 355, such as a Talin INS, and a position locator, such as a conventional Global Positioning System (GPS) receiver 360. Processor 310 and other elements of system 300 may be interconnected using conventional measures, such as bus architectures and the like.

Where system 300 is used only as an FDC 42 (FIG. 2), gun and driver displays 320, 325 may not be incorporated, though they may be included.

Figure 4:
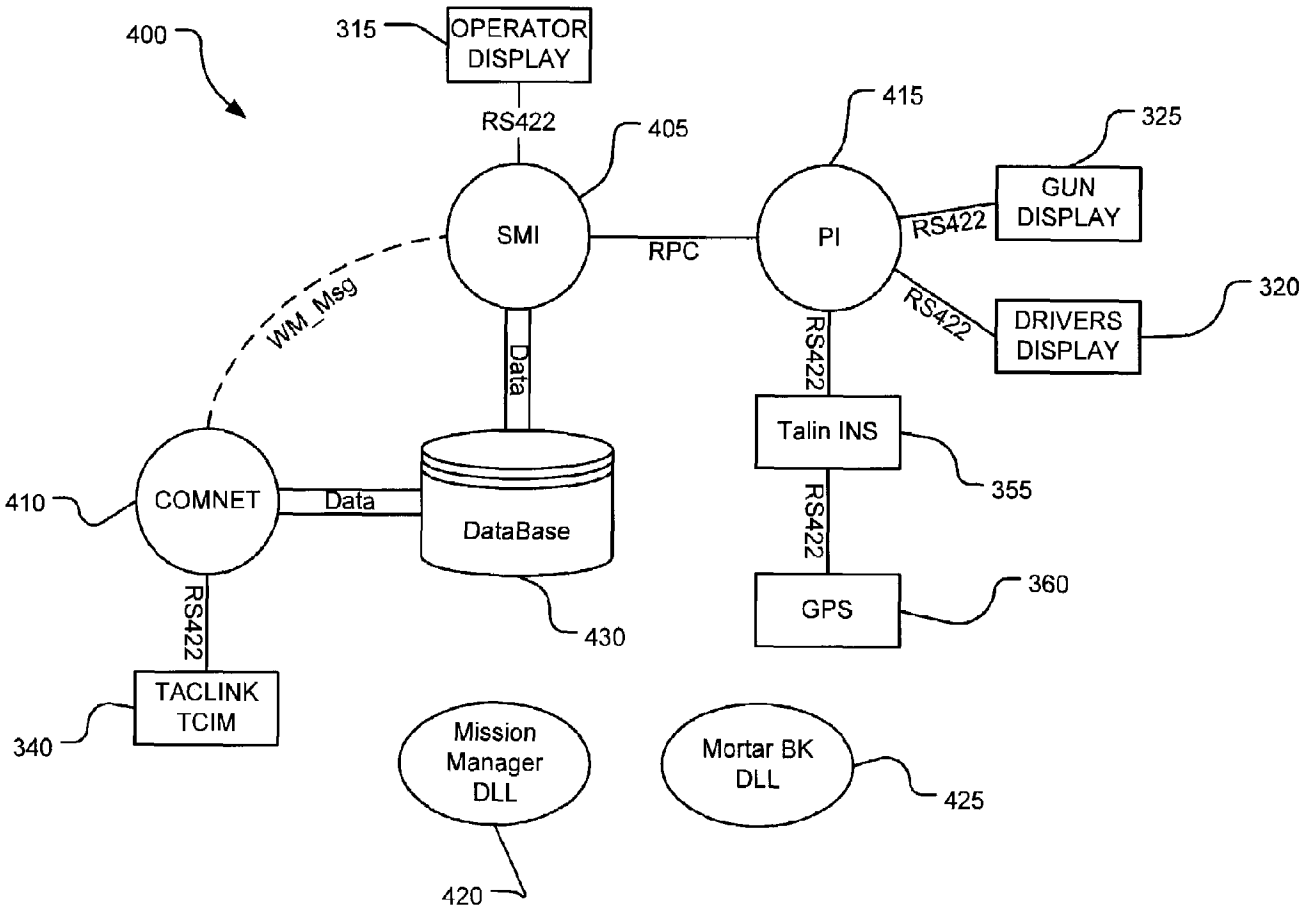
FIG. 4 illustrates a block diagrammatic representation of a computer software configuration item (CSCI) according to an aspect of the present invention; and, FIGS. 5-13 illustrate processes according to aspects of the present invention.

Referring now to FIG. 4, there is shown a block diagrammatic representation of a MFCS Computer Software Configuration Item (CSCI) 400 according to an aspect of the present invention and suitable for use with system 300 of FIG. 3. CSCI 400 includes six Computer Software Components (CSCs). Each CSC may take the form of an executable or dynamic link library, for example. Communications between CSCs may be accomplished through sharing information in a database and/or broadcasting event messages, for example. The six CSCs include a Soldier Machine Interface (SMI) 405, communications networker (COMNET) 410, Peripheral Interface (PI) 415, mission manager 420, ballistics kernel 425 and Database (DB) 430.

Briefly, SMI 405 is configured to provide a Graphical User Interface (GUI) between the MFCS and an operator using operator display 315 (FIG. 3). COMNET 410 is configured to handle digital communications with other fire support devices, over battalion and mortars communication networks (using modem 340 and radio 345 of FIG. 3 for example). PI 415 is configured to interface with the gunner display 325 (FIG. 3), driver display 320 (FIG. 3), PI 350 (FIG. 3), and INS 355 (FIG. 3). Optionally, if the system is configured on a vehicle that does not have an INS, then PI 350 may interface with a Precision Lightweight GPS Receiver (PLGR) directly, for example. Mission manager 420 is configured to process fire mission related digital messages. BK 425 includes information indicative of and is configured to compute, or assist in the computation of ballistic solutions, such as for 60 mm, 81 mm, and 120 mm mortars. And, database 430 is configured to provide non-volatile storage and synchronization of system data. Database 430 may take the form of a collection of Microsoft Access Database tables stored in data store 335 (FIG. 3), for example. Offline capabilities of Microsoft Access may be utilized, for example.

Figure 5:
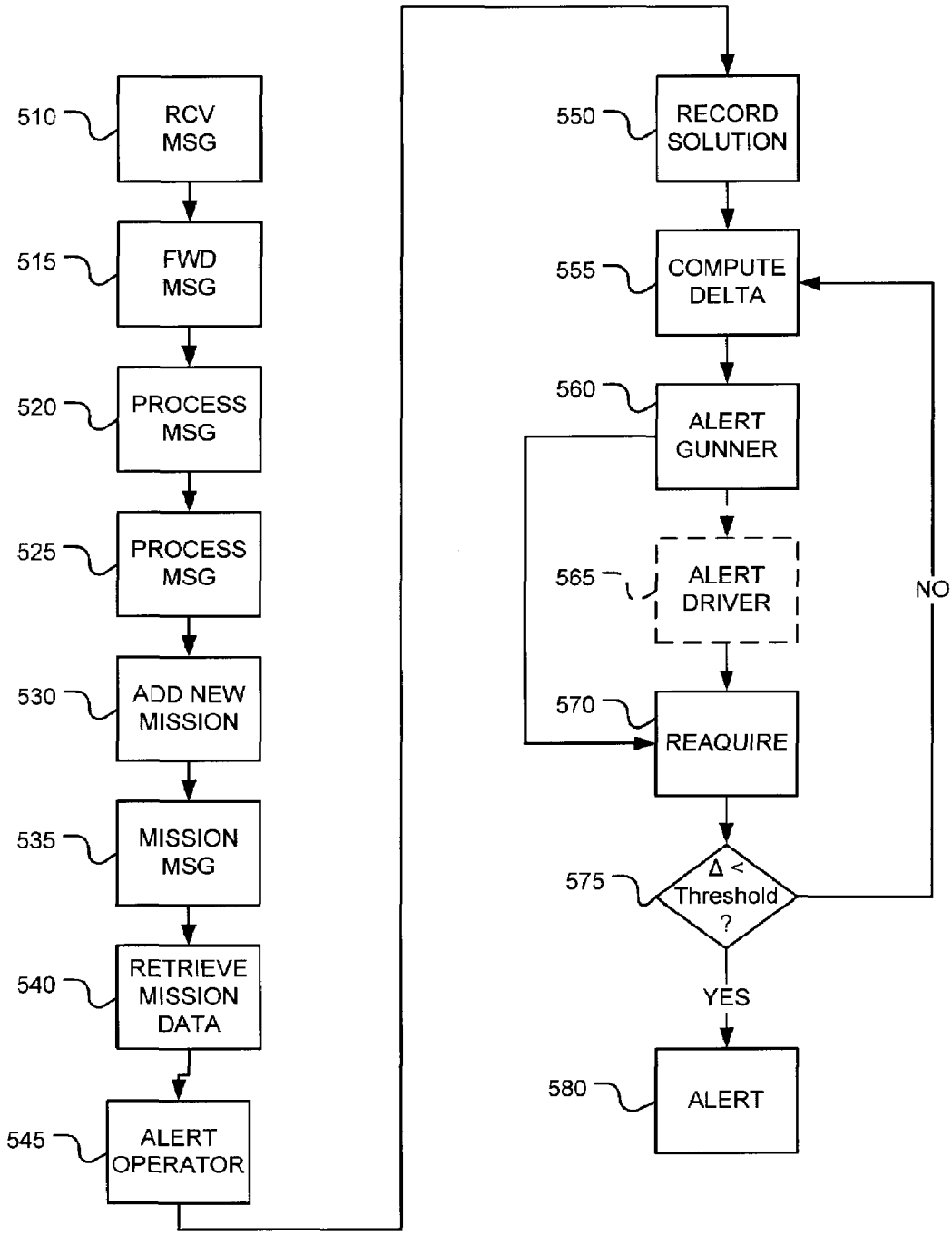

Referring now also to FIG. 5, there is shown a process 500 corresponding to a call for fire suitable for being processed by CSCI 400 of a gun system 44 (FIG. 2) according to an aspect of the present invention. In a first step 510, T/R module 340 receives a data indication message from a network, such as via radio 345 (FIG. 2). T/R module 340 forwards 515 this message to COMNET 410. COMNET 410 processes 520 the forwarded message to identify, extract and validate a fire command message. The fire command message may include firing parameters and orders, for example.

COMNET 410 may then add 525 a machine acknowledgement message (MACK) to a transmit queue in database 430. The MACK may be along the lines of a return receipt corresponding to the fire command message, for example. Database 430 may serve to queue up messages to be transmitted, and then send them to COMNET 410 for transmission via T/R module 430 according to conventional communications prioritization algorithms.

COMNET 410 may then call mission manager 420 to process the fire command message, and using the ballistics kernel 425, calculate a firing solution, using its known position (as may be acquired via GPS 360 (FIG. 3) for example). According to an aspect of the present invention, the received fire command message may include a firing solution as one of the parameters. In such a case, mission manager 420 may still calculate the firing solution and compare it against the received solution to confirm that the solution is accurate. If the calculated solution does not adequately match the received solution, a solution mismatch message may be queued up for transmission by T/R module 340. Possible reasons for solution mismatches include the gun being relocated without a corresponding FDC for the gun being updated about the new gun location. In this case, the received firing solution, calculated by the corresponding FDC using stale positional information or a characteristics associated with the gun will not match the firing solution calculated by the gun using its updated positional information. As will be recognized by those possessing an ordinary skill in the pertinent arts, this represents a significant improvement over conventional firing solution computation methods, as it allows for a gun choosing decision maker (an FDC, for example) to automatically confirm a firing solution for an assigned gun. If the solution does not match, it allows the decision maker to re-evaluate the gun choosing decision with the updated information rather than allowing a command decision to be based upon stale information.

Referring still to FIGS. 4 and 5, if the mission manager 420 calculated firing solution adequately matches the received solution, and/or the calculated firing solution is otherwise acceptable as meeting pre-defined criteria, i.e., not being within a no-fire zone, COMNET may add 530 a new fire mission to database 430. COMNET 410 may then send 535 a new mission notification message, such as a new fire command message, to SMI 405.

Responsively thereto, SMI 405 may retrieve 540 the firing data, which may include the calculated and/or received firing solution(s), from database 430. SMI 405 may also alert 545 the operator thereof of a new fire mission, such as by activating operator display 315 to illustrate images and/or text indicative of the new mission. SMI 405 may also send fire order data that may include the firing solution, to peripheral interface 415. PI 415 records 550 an azimuth, elevation, master ordnance configuration (MOC), shell type and fuse type, e.g., the firing solution in memory 330 (FIG. 3). PI 415 may also alert the driver and gunner about the new mission, e.g., via gunner and driver displays 325, 320.

PI 415 computes 555 the difference in, or delta, azimuth and elevation based upon the received order and the current direction the gun is pointed (i.e., using PI 350, INS 355 and/or GPS 360). PI 415 then alerts 560 the gunner of the computed deltas and fire orders, such as by causing them to be displayed to the gunner using the gunner's display 325 (FIG. 3). PI 415 may also alert 565 the driver of the delta azimuth, or difference between direction the gun needs to be pointed and direction it is currently pointed in azimuth, such as by causing the driver's display 320 to display the information, in case the vehicle supporting the gun needs to be moved to rectify the azimuth delta. The driver may be alerted for every fire order, selectively based upon an automated decision of whether the vehicle needs to be moved to rectify the delta or at a gunner's or operator's request, for example.

Periodically, such as at a rate of about 4 cycles per second for example, PI 415 may reacquire 570 current positional data regarding the gun. This may be accomplished via PI 350, INS 355 and/or GPS 360, for example. This information may be pulled or pushed, for example. P±315 may then repeat steps 555-575 until the delta is determined 575 to be within acceptable thresholds (i.e., has been rectified), for example. Once the delta has been rectified, the gunner, driver and/or operator may be notified 580 that the gun is pointed properly.

Figure 6:
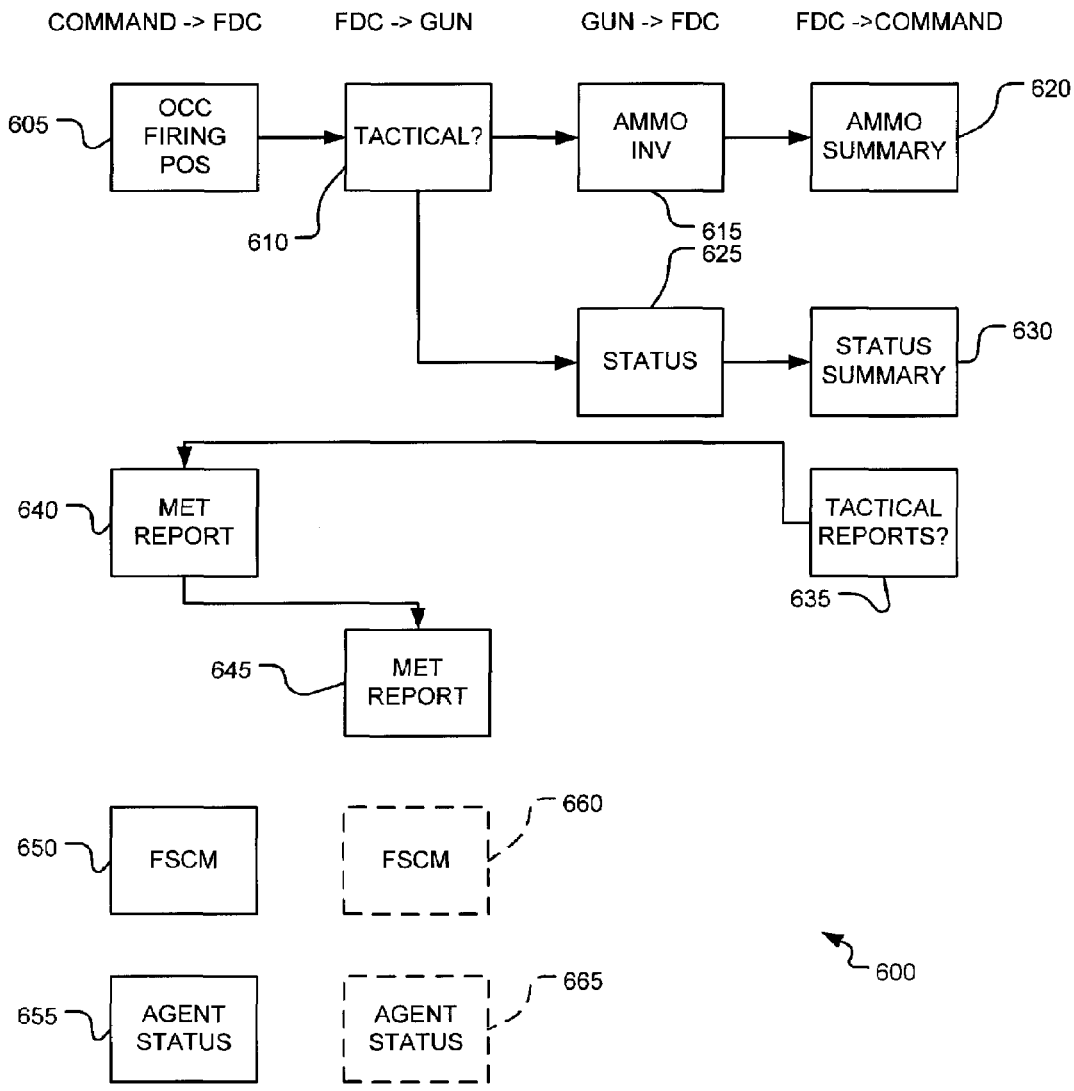

Referring now to FIGS. 1, 2 and 6, there is shown a process 600 corresponding to a gun occupying a firing position and initially providing and receiving information according to an aspect of the present invention. For purposes of completeness, it may be assumed that communications between a command 20 (FIG. 1) and fire system 40 (FIG. 1), and FDC 42 (FIG. 2) and Gun 44 (FIG. 2) have been properly established. Messages may be in the form User Datagram Protocol (UDP) messages, for example. Communications to and from control 20 may be via AFATDS, for example.

Command 20 may send 605 a message to an FDC 42 instructing that a firing position be occupied. This message may be in the form of a free-text message. FDC 42 may request 610 tactical reports, such as operational status and current ammunition supply, from guns 44, such as guns 44*a*-44*d*. This message may be a free text message. Ammunition inventory messages may then be sent 615 from each gun system 44 to FDC 42. An ammunition summary message, indicative of each of the ammunition inventory messages, may then be sent 620 from FDC 42 to command 20.

A gun status message may be sent 625 from each gun system 44 to FDC 42. This message may indicate the operational status of each gun. A status summary message, indicative of each of the gun status messages, may then be sent 630 from FDC 42 to command 20.

Tactical reports may be requested 635 by FDC 42 from command 20. The tactical reports may include information useful to FDC 42 and/or guns 44, such as atmospheric data, fire restrictions (i.e., no fire zones) and agent 30 locations. This request may take the form of a free text message. A meteorological tactical report 640 may be sent by command 20 to FDC 42. This report may be compiled from known meteorological conditions by command 20 in response to the request 635, for example. FDC 42 may forward 645 received meteorological reports to gun systems 44.

Command 20 forwards 650 fire support coordination information to FDC 42. This information may include such items as coordinated fire lines and no fire areas. Command 20 also forwards 655 the location of agents to FDC 42, also to facilitate fire support. This information may or may not be provided 660, 665 to gun systems 44.

Figure 7:
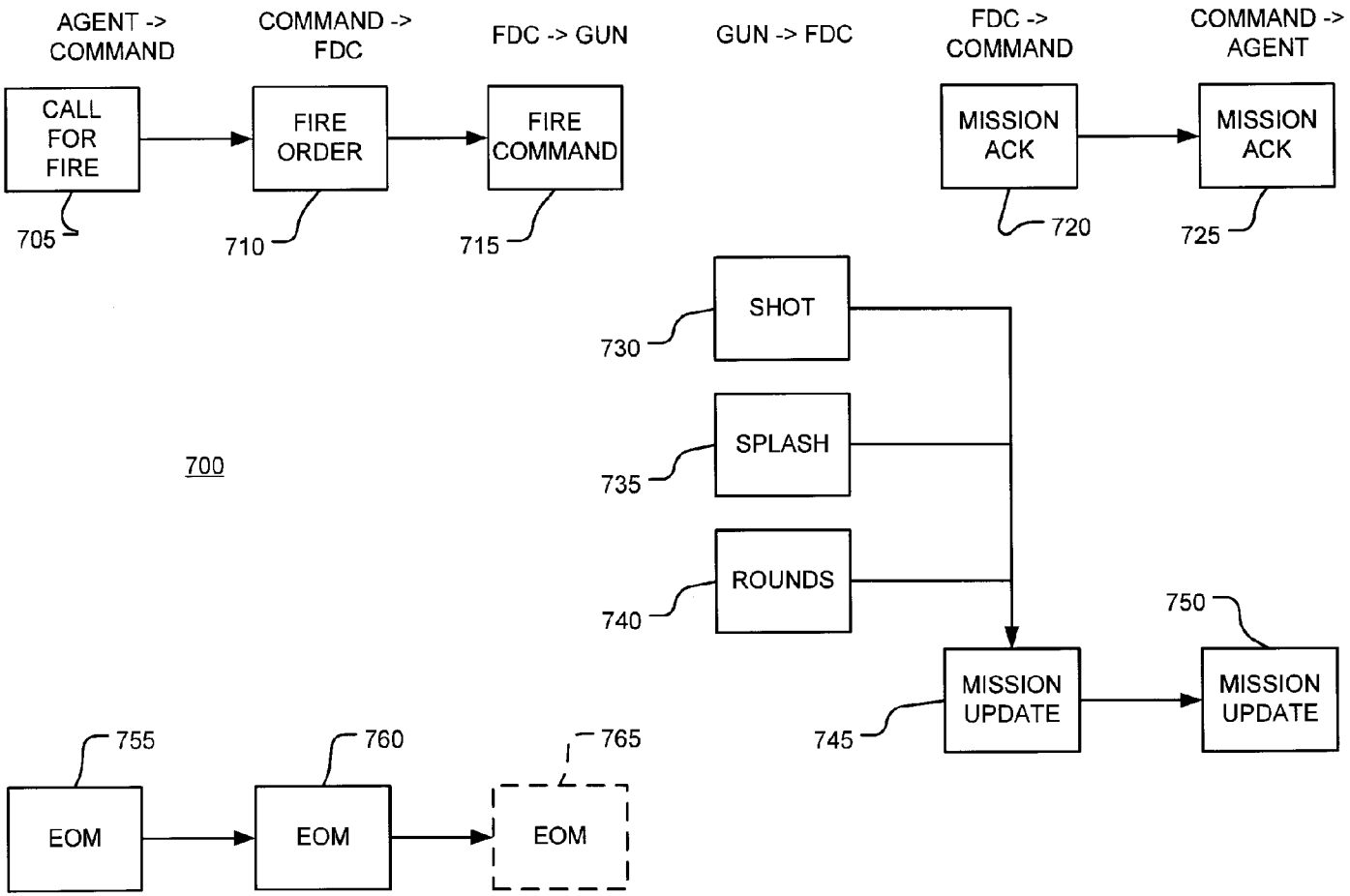

Referring now also to FIG. 7, there is shown a process 700 corresponding to a call for immediate smoke. This represents one type of shell that may be fired by a gun 44. Illustrated process 700 begins with a call for fire 705 (designating immediate smoke) from agent 30 to command 20. A corresponding fire order with immediate smoke message is sent 710 from command 20 to FDC 42. The fire order may include the call for fire message, or information indicative thereof. The fire order may indicate a number of ordered volleys, taking the expected number of rounds expected to be fired per volley into account. A corresponding fire command is sent 715 from FDC 42 to gun systems 44. The fire command may again include the call for fire message, or information indicative thereof. FDC 42 may send 720 a mission acknowledge message that may include a message to agent or observer component, to command 20. The mission acknowledgement message may again include the call for fire message, or information indicative thereof. The mission acknowledgement message may be sent 725 by command 20 to agent 30, to indicate the mission has been approved.

A mission update message may be sent 730 from each gun system 44 to FDC 42 each time a shot has been fired. A message may also be sent 735 each time a splash is observed. A message may also be sent 740 after a shot has been fired and a splash has been observed indicating the number of rounds expended. One or more of these messages may again include the call for fire message, or information indicative thereof. One or more mission update messages 745 may be sent from FDC 42 to command 20. These mission update messages may indicate a first shot has been fired, a first splash has been observed and a last round has been expended. A mission update message may then be sent 750 from command 20 to agent 30, to indicate shots have been fired, splashes have been observed and the number of rounds that have been completed.

Agent 30 may send 755 command 20 a mission complete message to indicate an end of mission. A corresponding end of mission message may be sent 760 from command 20 to FDC 42. Optionally, a corresponding end of mission message may be sent 765 from FDC 42 to gun systems 44.

Figure 8:
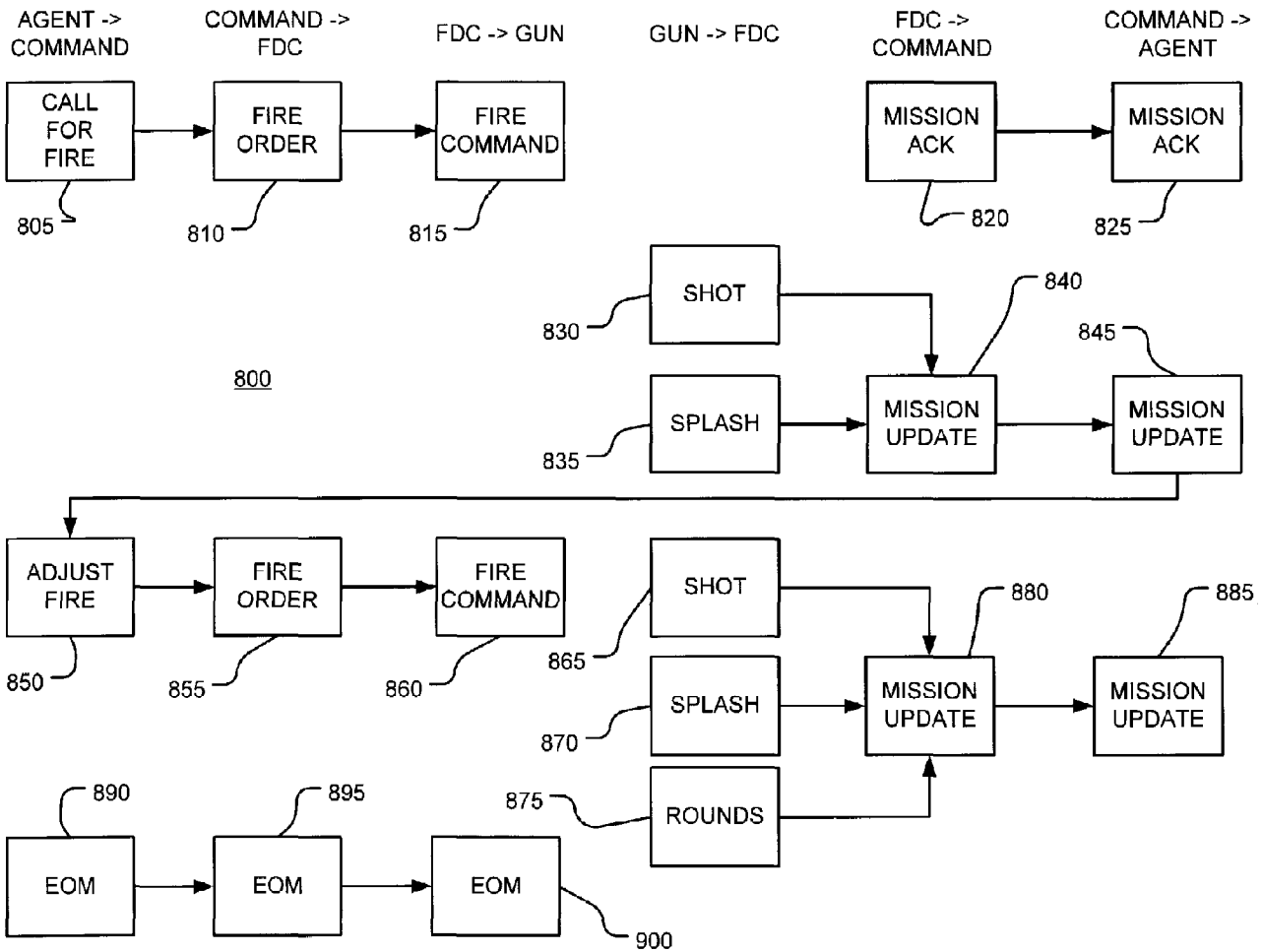

Referring now also to FIG. 8, there is shown a process 800 for an adjust fire call. This call may be suitable to adjust the ranging of and aim of gun systems 44. Illustrated process 800 begins with a call for fire 805 with an adjust fire request from agent 30 to command 20. A corresponding fire order with an adjust fire message is sent 810 from command 20 to FDC 42. The fire order may include the call for fire message, or information indicative thereof. The fire order may indicate a number of ordered volleys, taking the expected number of rounds expected to be fired per volley into account. A corresponding fire command is sent 815 from FDC 42 to gun systems 44. The fire command may again include the call for fire message, or information indicative thereof. FDC 42 may send 820 a mission acknowledge message that may include a message to agent or observer component, to command 20. A mission acknowledgement message may again include the call for fire message, or information indicative thereof. The mission acknowledgement message may be sent 825 by command 20 to agent 30, to indicate the mission has been approved.

A mission update message may be sent 830 from each gun system 44 to FDC 42 each time a shot has been fired. A message may also be sent 835 each time a splash is observed. One or more of these missions may again include the call for fire message, or information indicative thereof. One or more mission update messages 840 may be sent from FDC 42 to command 20. These mission update messages may indicate a first shot has been fired and a splash has been observed. A mission update message may be sent 845 from command 20 to agent 30, to indicate shots have been fired and splashes have been observed.

Agent 30 may then send 850 command 20 a subsequent adjust fire message, requesting a change to firing coordinates, i.e., a requested shift, and optionally a fire for effect request, for example. A corresponding adjust fire order may be sent 855 from command 20 to FDC 42. A corresponding adjust fire command may be sent 860 from FDC 42 to guns 44.

A mission update message may be sent 865 from each gun system 44 to FDC 42 each time a shot has been fired. A message may also be sent 870 each time a splash is observed. A message may also be sent 875 after a shot has been fired and a splash has been observed indicating the number of rounds expended. One or more of these messages may again include the call for fire message, or information indicative thereof. One or more mission update messages 880 may be sent from FDC 42 to command 20. These mission update messages may indicate a first shot has been fired, a first splash has been observed and a last round has been expended. A mission update message may be sent 885 from command 20 to agent 30, to indicate shots have been fired, splashes have been observed and the number of rounds that have been expended.

Agent 30 may send 890 command 20 a mission complete message to indicate an end of mission. A corresponding end of mission message may be sent 895 from command 20 to FDC 42. A corresponding end of mission message may be sent 900 from FDC 42 to gun systems 44.

Figure 9:
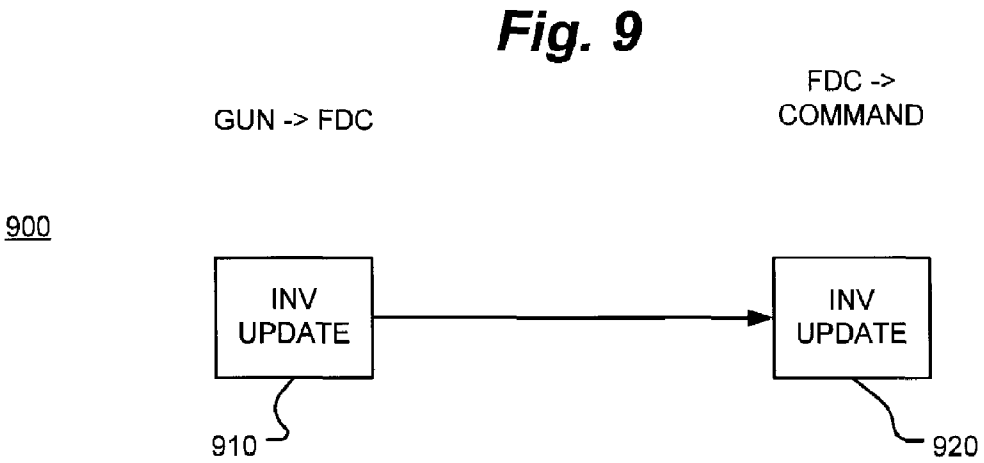

Referring now also to FIG. 9, there is shown a process 900 suitable for use after receipt of an end of mission message by a gun system 44. Process 400 may also be executed at predetermined intervals, upon request, or after any firing activity, for example. An inventory update message may be sent 910 from a gun system 44 to FDC 42. One or more corresponding inventory update messages, either independently or in the form of a summary, may be sent 920 from FDC 42 to command 20.

Figure 10:
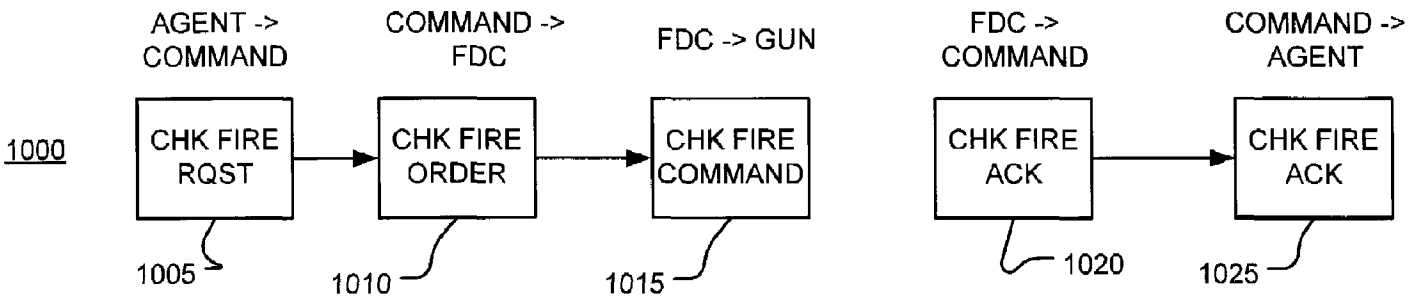

Referring now also to FIG. 10, there is shown a process 1000 for effecting a check fire. As is understood by those possessing an ordinary skill in the pertinent arts, a check fire is an immediate request to hold fire. For purposes of completeness, process 1000 may be well suited after a call for fire is being acted upon, such as after step 725 of FIG. 7, or steps 825 or 860 of FIG. 8.

Illustrated process 1000 begins with a checkfire request 1005 from agent 30 to command 20. A corresponding check fire order is sent 1010 from command 20 to FDC 42. The check fire order may include the agent check fire message, or information indicative thereof. A corresponding check fire command is sent 1015 from FDC 42 to gun systems 44. The check fire command may again include the check fire message, or information indicative thereof. FDC 42 may send 1020 a mission acknowledge message that may include a message to agent or observer component, to command 20. The mission acknowledgement message may again include the check fire message, or information indicative thereof. The mission acknowledgement message may be sent 1025 by command 20 to agent 30, to indicate the check fire has been approved. The check fire messages may refer to target numbers or mission related information, to ensure the check fire is acted upon the proper mission.

Figure 11:
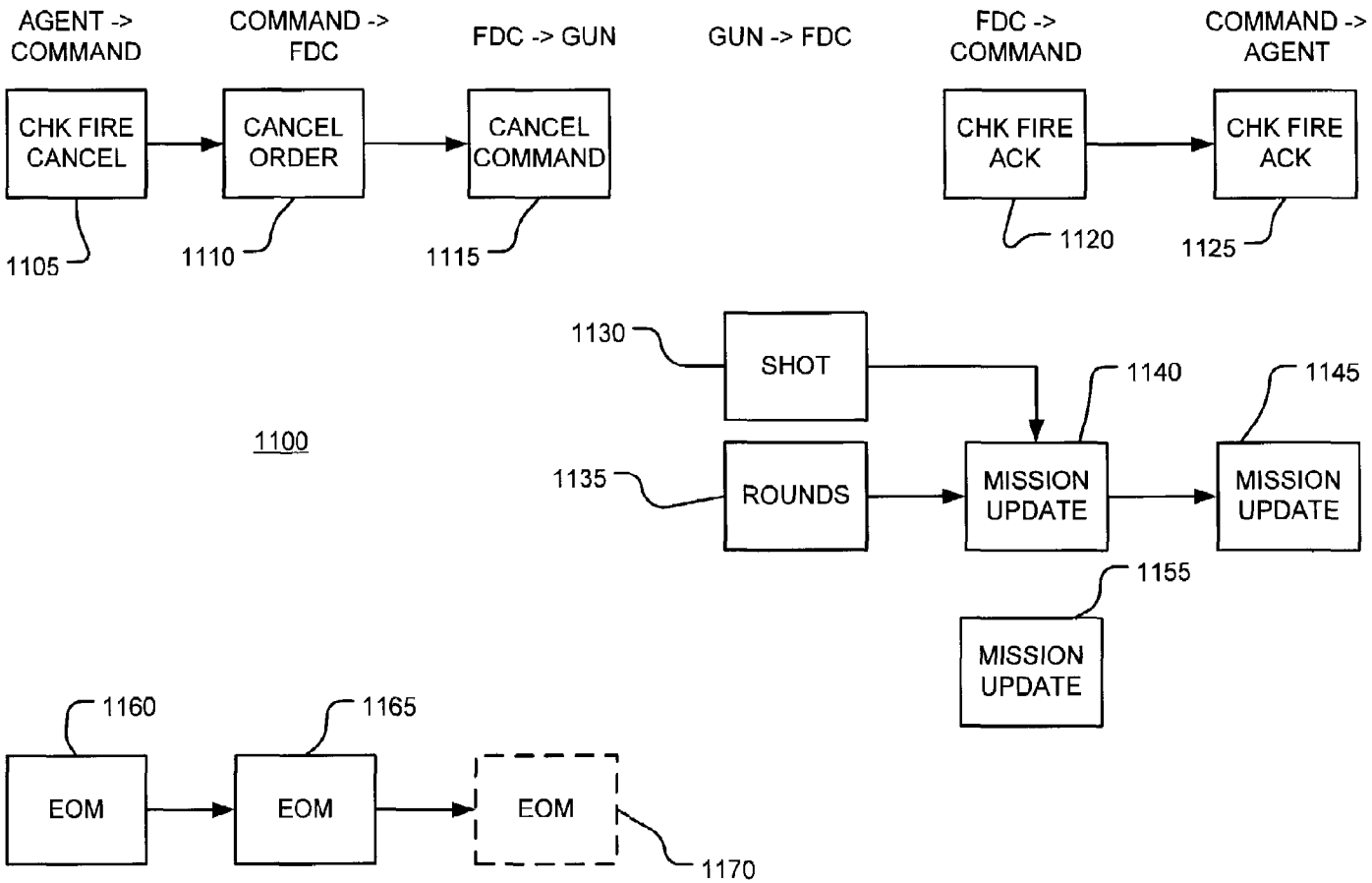

Referring now also to FIG. 11, there is shown a process 1100 for canceling a check fire. Illustrated process 1100 begins with a check fire cancel request 1105 from agent 30 to command 20. A corresponding cancel order with is sent 1110 from command 20 to FDC 42. The order may include the cancel check fire message, or information indicative thereof. A corresponding cancel command is sent 1115 from FDC 42 to gun systems 44. The cancel command may again include the cancel check fire message, or information indicative thereof. FDC 42 may send 1120 a mission acknowledge message that may include a message to agent or observer component, to command 20. The mission acknowledgement message may again include the check fire cancel message, or information indicative thereof. A mission acknowledgement message may be sent 1125 by command 20 to agent 30, to indicate the checkfire has been cancelled. Alternatively, acknowledgement messages may not be used.

Regardless, a mission update message may be sent 1130 from each gun system 44 to FDC 42 each time a shot has been fired. A message 1135 may also be sent indicating the number of rounds expended. A message indicating a splash has been observed may, or may not, be sent. One or more of these messages may again include the call for fire message, or information indicative thereof. One or more mission update messages 1140 may be sent from FDC 42 to command 20. These mission update messages may indicate a first shot has been fired and a number of rounds that has been expended. A mission update message may also be sent 1155, in fire missions without check fires as well, from FDC 42 to command 20 to indicate that the first shot and the last of the rounds have been completed. A mission update message may be sent 1150 from command 20 to agent 30, to indicate shots have been fired and the number of rounds completed, and optionally that the first of the shots have been made and the last of the rounds completed.

Agent 30 may send 1160 command 20 a mission complete message to indicate an end of mission. A corresponding end of mission message may be sent 1165 from command 20 to FDC 42. Optionally, a corresponding end of mission message may be sent 1170 from FDC 42 to gun systems 44. An ammunition update process, such as that illustrated in FIG. 9, may also be effected.

Figure 12:
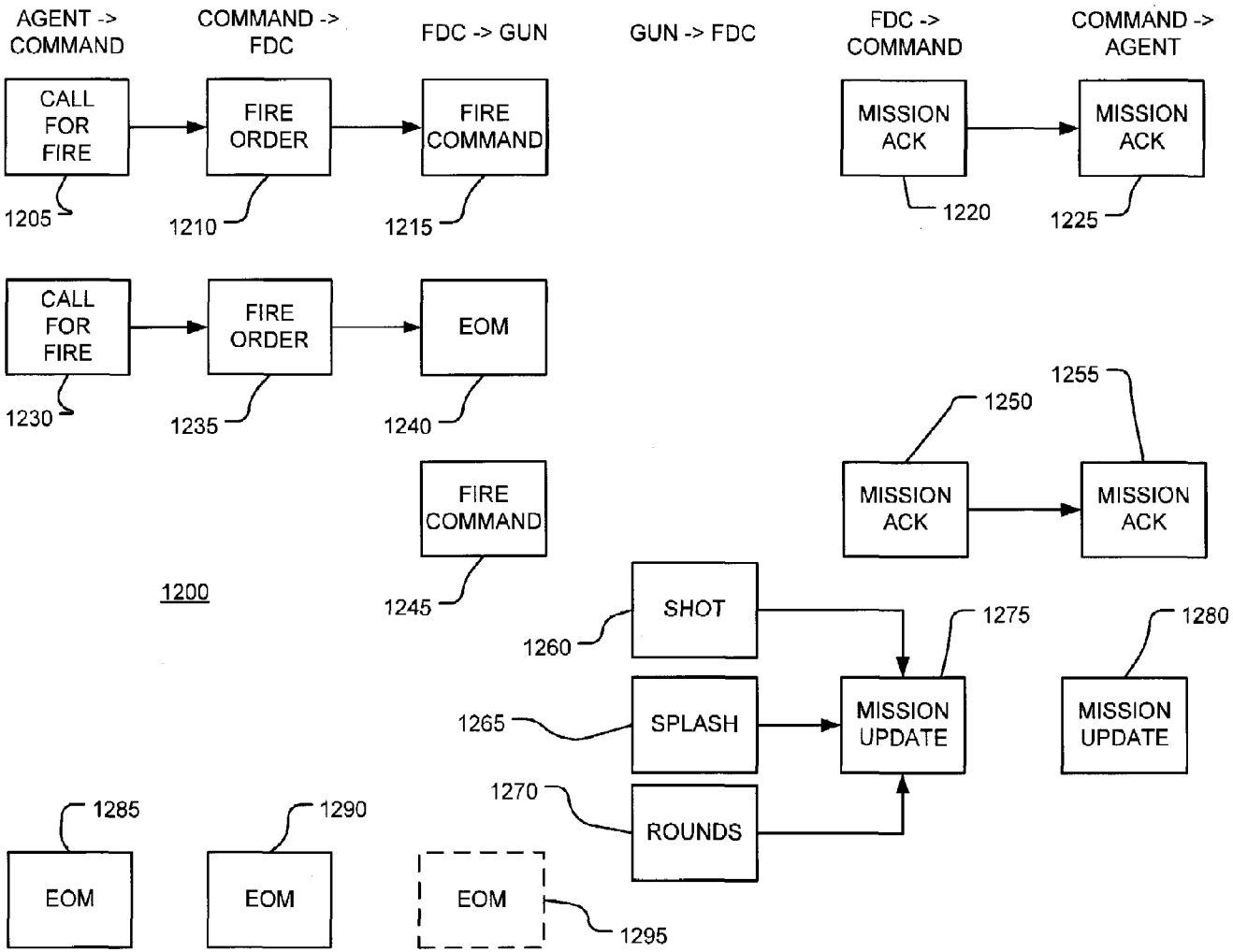

Referring now to FIGS. 1, 2 and 12, there is shown a process 1200 for simultaneous fire missions according to an aspect of the present invention. Illustrated process 1200 begins with a first call for fire 1205 from agent 30 to command 20. A corresponding first fire order message is sent 1210 from command 20 to FDC 42. A corresponding fire command is sent 1215 from FDC 42 to gun systems 44*a*-44*d*. FDC 42 may send 1220 a mission acknowledge message to command 20. A mission acknowledgement message may be sent 1225 by command 20 to agent 30, to indicate the mission has been approved.

While in the course of conducting the first mission, agent 20 requests 1230 a second call for fire. A corresponding second fire order message is sent 1235 from command 20 to FDC 42.

In response thereto, FDC 42 may issue 1240 an end of mission to gun systems 44*c*, 44*d*—to in effect free up these resources for the second call for fire order. Gun systems 44*c*, 44*d* may conduct an inventory messaging, as shown in FIG. 9, for example.

FDC 42 may issue 1245 a fire command to gun systems 44*c*, 44*d* corresponding to the second fire order message. FDC 42 may send 1250 a mission acknowledge message to command 20. A mission acknowledgement message may be sent 1255 by command 20 to agent 30, to indicate the second mission has been approved.

A mission update message may be sent 1260 from each gun system 44 to FDC 42 each time a shot has been fired. For the first mission in the case of gun systems 44*a*, 44*b*, and for the second mission in the case of gun systems 44*c*, 44*d*. Another message may be sent 1265 from each gun system 44 to FDC 42 indicating a splash has been observed. And, a message 1270 may also be sent indicating the number of rounds expended. One or more of these messages may again include the corresponding call for fire message, or information indicative thereof. One or more mission update messages 1275 may be sent from FDC 42 to command 20. These mission update messages may indicate a first shot has been fired, a first splash has been observed and a last round has been expended. A mission update message may be sent 1280 from command 20 to agent 30, to indicate shots have been fired and the number of rounds completed, and optionally that the first of the shots have been made and the last of the rounds completed.

Agent 30 may send 1285 command 20 a mission complete message to indicate an end of mission corresponding to the first or second mission. A corresponding end of mission message may be sent 1290 from command 20 to FDC 42. Optionally, a corresponding end of mission message may be sent 1295 from FDC 42 to gun systems 44. An ammunition update process, such as that illustrated in FIG. 9, may also be effected.

Figure 13:
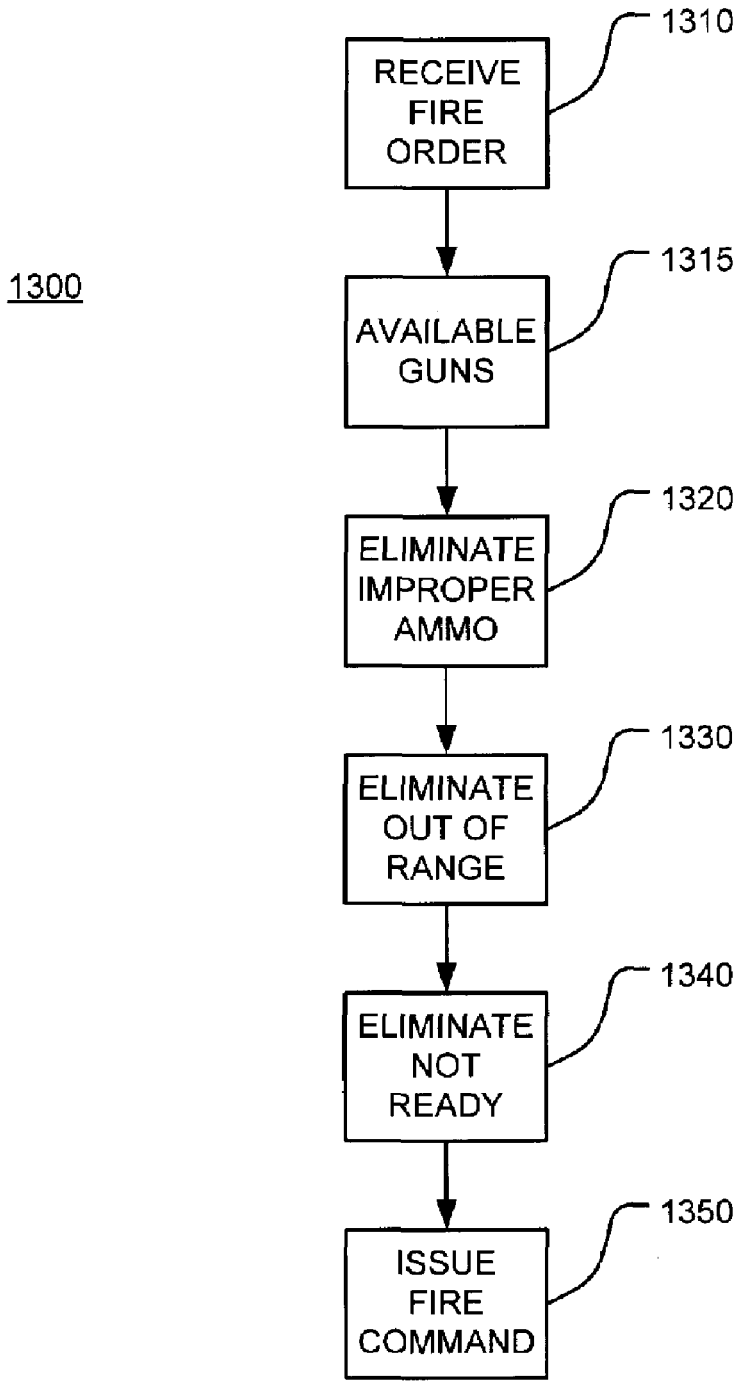

Referring now also to FIG. 13, there is shown a process 1300 for selecting guns to issue fire commands to. Process 1300 may be used by FDC 42 when a fire command is received from command 20. Upon receipt of a fire command 1310, available gun systems (e.g., 44*a*-44*d* of FIG. 2) may be identified 1315. Guns not having the appropriate type of ammunition for the received fire order may be eliminated from consideration 1320. Guns that are not in range to fulfill the received fire order may be eliminated from consideration 1330. Guns not reporting an operationally ready state may be eliminated from consideration 1340. Finally, FDC 42 may issue a fire command 1350 to the remaining guns (e.g., gun systems 44*c*, 44*d* in the example of FIG. 12).

FDC 42 may optionally issue fire commands to suitable gun systems 44 that represent a total number of shots that correspond to the total number of expected shots expected by command 20. For example, if command 20 ordered two volleys from FDC 42, assuming that each of four gun systems would fire for each volley, FDC may order four volleys to two guns if only two guns are determined to be suitable for carrying out the ordered mission, thereby commanding a number of shots consistent with the number of shots expected by command 20.

It will be apparent to those skilled in the art that various modifications and variations may be made in the apparatus and process of the present invention without departing from the spirit or scope of the invention. Thus, it is intended that the present invention cover the modification and variations of this invention provided they come within the scope of the appended claims and their equivalents.

What is claimed is:

1. An indirect artillery fire control system comprising:

a plurality of indirect artillery systems, each indirect artillery system comprising:

code for receiving a fire command;

code for computing a ballistic solution corresponding to said received fire command;

code for comparing said computed ballistic solution with said fire command; and, code for readying said indirect artillery system to fire only if said comparing indicates a substantial match; and, a fire direction system comprising:

code for receiving a call for fire order;

code for selecting at least one of said plurality of indirect artillery systems dependently upon at least one characteristic of said plurality of indirect artillery systems; and, code for issuing a fire command corresponding to said call for fire order to said selected at least one of said plurality of indirect artillery systems.

2. The system of claim 1, wherein each of said indirect artillery systems comprise:

a central processing unit; and, a datastore accessible by said central processing unit and comprising data indicative of received commands.

3. The system of claim 2, wherein each of said indirect artillery system further comprises a memory for storing said code.

4. The system of claim 3, wherein each said indirect artillery system comprises a modem.

5. The system of claim 4, wherein each said indirect artillery system further comprises a locating device being communicative with said central processing unit.

6. The system of claim 5, wherein said locating device comprises an inertial navigation system.

7. The system of claim 6, wherein said locating device further comprises a global positioning receiver.

8. The system of claim 7, further comprising an operator display.

9. The system of claim 8, wherein said fire direction system is substantially identical to each of said indirect artillery systems.

10. The system of claim 7, wherein each of said indirect artillery systems further comprises a driver display and a gunner display.

11. The system of claim 1, wherein each said indirect artillery system further comprises code for:

determining a current azimuth and elevation associated with said indirect artillery system;

comparing said determined azimuth and elevation to said ballistic solution; and, displaying a difference based upon said comparing.

12. The system of claim 1, wherein each said indirect artillery system further comprises:

code for reporting at least one of said characteristics to said fire direction system.

13. The system of claim 12, wherein said characteristics comprise:

ammunition; and, operational status.

14. The system of claim 1, wherein said fire direction system further comprises code for requesting tactical information from said command.

15. The system of claim 4, wherein each said indirect artillery system further comprises code for reporting a shot taken.

16. The system of claim 5, wherein said fire direction system further comprises code for reporting shots taken by said plurality of indirect artillery systems.

17. The system of claim 1, wherein said fire direction system further comprises code for ending a fire command.

18. The system of claim 1, wherein each of said indirect artillery systems is paired with a mortar system.

19. The system of claim 1, further comprising a plurality of fire direction systems each having an associated plurality of indirect artillery systems.

20. The system of claim 1, further comprising an inertial navigation system.

* * * * *